US007918547B2

(12) United States Patent
Hatasa et al.

(10) Patent No.: US 7,918,547 B2
(45) Date of Patent: Apr. 5, 2011

(54) LIQUID STORAGE CONTAINER AND INK JET RECORDING APPARATUS

(75) Inventors: Nobuyuki Hatasa, Kawasaki (JP); Takatoshi Kitagawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 382 days.

(21) Appl. No.: 11/665,547

(22) PCT Filed: Oct. 20, 2005

(86) PCT No.: PCT/JP2005/019738

§ 371 (c)(1),
(2), (4) Date: Jan. 16, 2009

(87) PCT Pub. No.: WO2006/043718

PCT Pub. Date: Apr. 27, 2006

(65) Prior Publication Data

US 2009/0122092 A1 May 14, 2009

(30) Foreign Application Priority Data

Oct. 20, 2004 (JP) ..... 2004-306132

(51) Int. Cl.
*B41J 2/175* (2006.01)

(52) U.S. Cl. ..... 347/86

(58) Field of Classification Search ..... 347/7, 84–86; 250/573–577

See application file for complete search history.

(56) References Cited

U.S. PATENT DOCUMENTS

| | | | | |
|---|---|---|---|---|
| 5,500,665 | A | 3/1996 | Ujita et al. | 347/86 |
| 5,504,512 | A | 4/1996 | Shimoda et al. | 347/86 |
| 5,616,929 | A | 4/1997 | Hara | 250/573 |
| 6,097,405 | A | 8/2000 | Lo et al. | 347/6 |
| 6,540,314 | B1 | 4/2003 | Sanada et al. | 347/7 |
| 6,616,255 | B2 | 9/2003 | Murakami et al. | 347/7 |
| 6,893,118 | B2 * | 5/2005 | Murakami et al. | 347/84 |
| 7,213,914 | B2 | 5/2007 | Anma et al. | 347/86 |
| 2004/0109039 | A1 | 6/2004 | Kojima et al. | 347/19 |
| 2005/0219303 | A1 * | 10/2005 | Matsumoto et al. | 347/19 |
| 2006/0290722 | A1 | 12/2006 | Kitagawa et al. | 347/7 |

FOREIGN PATENT DOCUMENTS

| | | |
|---|---|---|
| CN | 1495415 | 5/2004 |
| EP | 1547781 | 6/2005 |
| JP | 7-218321 | 8/1995 |
| JP | 8-1958 | 1/1996 |
| JP | 8-43174 | 2/1996 |
| JP | 2000-15837 | 1/2000 |
| JP | 2000-43282 | 2/2000 |

(Continued)

OTHER PUBLICATIONS

English language translation of Taiwan Office Action and Search Report in corresponding Taiwan Application No. 94136569.

European Office Action dated Feb. 17, 2010, from corresponding European Application No. 05799273.7.

(Continued)

*Primary Examiner* — Julian D Huffman
*Assistant Examiner* — Jason S Uhlenhake
(74) *Attorney, Agent, or Firm* — Fitzpatrick, Cella, Harper & Scinto

(57) ABSTRACT

A liquid container for containing liquid includes an optical path formation member for forming an optical path for guiding to an operating portion light received from an outside at a predetermined position of the liquid container, the optical path forming member constituting a part of the liquid container, wherein the operating portion is caused to emit light by the light guided by the optical path.

7 Claims, 16 Drawing Sheets

FOREIGN PATENT DOCUMENTS

| | | |
|---|---|---|
| JP | 2000-043282 | 2/2000 |
| JP | 2002-301829 | 10/2002 |
| KR | 2000-029298 | 5/2000 |
| RU | 2141898 | 11/1999 |
| TW | 215634 | 11/1993 |
| TW | 219007 | 1/1994 |
| WO | 95/32864 | 12/1995 |

OTHER PUBLICATIONS

Decision on Grant from corresponding Russian Application No. 2007112119, and English language translation thereof.

Chinese Office Action dated Aug. 28, 2009, from corresponding chinese Application No. 2005800358434.

Korean Office Action dated Oct. 28, 2008, from corresponding Korean Application No. 10-2007-7008860.

* cited by examiner (a)

(b)

(a)

(b)

LIQUID STORAGE CONTAINER AND INK JET RECORDING APPARATUS

TECHNICAL FIELD

The present invention relates to a liquid storage container such as an ink container, and an ink jet recording apparatus employing a liquid storage container. More specifically, it relates to a structural arrangement for indicating a specific liquid container to inform a user of a predetermined condition of the specific container.

BACKGROUND ART

An ink jet recording method is a method for printing an intended image by projecting ink droplets from the minuscule orifices of a recording head so that the ink droplets land on recording medium. In the field of color printing, a color printer which uses four inks different in color, that is, black, cyan, magenta, and yellow inks, to print a color image has been the mainstream color printer. In recent years, however, for the improvement of image quality and color reproducibility, inks other than the abovementioned primary four color inks have come to be used in addition to the four color inks. For example, in the field of a printer for printing high quality images such as photographic images, for the purpose of improving a printer in terms of gradation to reproduce subtle variations in natural colors, such cyan and magenta inks that are lower in the density of coloring material, such as dye, than the aforementioned primary cyan and magenta inks have come to be used in addition to the primary ones. Further, in some cases, for the purpose of widening the range of colors reproducible with a color printer to further improve a printer in terms of color reproducibility, inks different in color from the abovementioned four primary color inks are used in addition to the primary ones.

As the number of the inks used for image formation increases as described above, the number of ink containers therefor increases, making it thereby difficult to select a correct ink container from among a large number of ink containers different in the properties of the ink therein, for the following reason. That is, not only are there too many inks different in color and other properties, but also, ink names and/or color names under which ink containers are called are too close to each other. For example, the cyan and magenta inks employed specifically for photographic printing in addition to the primary cyan and magenta inks may be called PhotoCyan and PhotoMagenta to imply their photographic usage, or LightCyan and LightMagenta to imply their lower coloring material densities. In other words, the name containing the color name for the name of the primary ink, that is, cyan or magenta, is frequently used for the secondary (additional) ink. Moreover, the color of the color strip printed on an identification label for an ink container for a secondary color ink is often very close to that for an ink container for the corresponding primary color ink.

As for a situation in which a specific ink container must be indicated from among multiple ink containers, there is a case, for example, in which one (or more) of the ink containers in an image forming apparatus has been depleted of the ink, and therefore, this ink container must be indicated so that it can be replaced. In such a case, that is, when the amount of the ink in an ink container falls below a predetermined value below which recording cannot be satisfactorily made, usually, it is detected by a printer, with the use of some sort of method (for example, method disclosed in Japanese Laid-open Patent Application 8-043174), that the ink in the ink container has been depleted, and the printer informs a user of the detected result, by way of a host computer or the like. Then, the user is to find the identity of the ink container to be replaced, and to replace it with an identical replacement ink container. Usually, the user finds the identity of the ink container to be replaced, based on the letters, or the strip of color, for example, on the label on the ink container to be replaced.

However, there are a large number of ink container types, and also, it is rather difficult to differentiate between two ink containers which are similar in the identification letters, or the color of the identification strip, on the ink container label, as described above, making therefore the task of identifying an ink container somewhat annoying to a user, or making longer the time it takes for a user to identify an ink container. Further, to a user with reduced eyesight, such as an older user, or a user unfamiliar with the printer operation, it is very difficult to find a correct ink container from among a large number of ink containers which are similar in the letters, or the color of the identification strip, of an ink container label.

Japanese Laid-open Patent Application 2000-015837 discloses an idea as one of the solutions to the abovementioned problem. According to this idea, the main assembly of a printer is provided with multiple light emitting members, for example, LEDs, which correspond one for one to the multiple ink containers employed by the printer, so that the light emitting member(s) corresponding to the ink container(s) to be replaced, that is, the ink container(s) which is critically low in the amount of the ink therein, can be lit to inform a user of the ink container(s) to be replaced.

This structural arrangement is virtually the same as the above described method of informing a user of an ink container to be replaced, through a host computer. That is, it simply informs a user of the color of the ink in the ink container having run out of ink. In other words, in the case of this structural arrangement, there is a certain amount of distance between each light emitting member and the corresponding ink container. Therefore, it can indicate which ink container is to be replaced, only in terms of the color of the ink therein; it cannot directly indicate the ink container to be replaced. Therefore, it cannot solve the above described problem. Moreover, even if a user memorizes the relationship between each light emitting member and the corresponding ink container, in terms of position and identity, it is rather difficult for the user to retain the memory, because the ink container replacement occurs at relatively long intervals, for example, once in several months.

Japanese Laid-open Patent Application 2002-301829 discloses an idea of providing a printer with multiple lamps for warning a user of the amount of ink in the corresponding ink containers. These lamps are disposed, one for one, on the ink containers themselves, or on the ink container locking levers of the main assembly of the printer located near the ink container placement spaces. According to this application, a user is enabled to directly recognize the ink container(s) responsible for turning on the ink remainder warning lamp(s) on the main assembly side of the printer, because the warming lamp(s) is on, or near, the ink container(s) responsible for turning on the warming lamp(s). Therefore, it is easier for a user to know that a specific ink container is short of ink.

However, the structural arrangement which Japanese Laid-open Patent Application 2002-301829 discloses, that is, a structural arrangement which places the warning lamps On the ink container locking levers, each of which will be in the adjacencies of the corresponding ink container when the ink container is mounted, can be applicable to only apparatuses in which each of the locking levers or the like will be in the adjacencies of the corresponding ink container placement space. In other words, this structural arrangement cannot be applied to a wide range of apparatuses. Obviously, it is possible to modify this structural arrangement to make it widely applicable. For example, it is possible to place the warning lamps on the structural components of the carriage on which the ink containers are mounted. This modification, however, creates a problem. That is, the variety in carriage specification and carriage design makes it difficult to place all the warning lamps close enough to the corresponding ink containers, creating situations in which when a given lamp is lit, the ink container corresponding to the lit lamp cannot be directly recognized. In addition, modifying carriage design to achieve the above described object reduces latitude in carriage design.

DISCLOSURE OF THE INVENTION

The present invention was made to solve the above described problems, and its primary object is to provide the combination of a liquid storage container, such as an ink container, and an ink jet recording apparatus, which can directly display to a user a predetermined condition(s), the identity, and the location, of the container, while being simple in structure.

The present invention which makes it possible to achieve the abovementioned object is characterized in that a part, or parts, of a liquid storage container for storing liquid comprises a light path for guiding the light emitted at a predetermined location by an external light emitting source, to the finger placement portion (tab portion) of the liquid storage container (which is for manipulating liquid storage container) to illuminate the finger placement portion (tab portion).

Further, the present invention, which relates to an ink jet recording apparatus which employs ink containers for storing ink, comprises members for mounting the ink containers, and records images with the use of a recording head(s) for ejecting the ink supplied from the ink containers, is characterized in that the ink recording apparatus further comprises: a controlling means, a single or multiple light emitting members attached to the abovementioned ink container mounting members, and that, a part, or parts, of each of the ink containers comprises a light path for guiding the light which it receives from the light emitting member, to the abovementioned finger placement portion (tab portion) of the liquid storage container, and the controlling means illuminates the finger placement portion (tab portion) by turning on the light emitting member so that the light from the light emitting member illuminates the finger placement portion (tab portion) by travelling through the light path.

With the provision of the above described structural arrangement, as the amount of the ink remainder in one of the ink containers as liquid storage container falls below the critical value, the condition of this ink container is detected. As the condition is detected, a light emitting member, which is not on the ink container, is turned on, and the light from the light emitting member is guided through the light path of the ink container to the finger placement portion (tab portion) of the ink container, or the like, to the finger placement portion (tab portion). As a result, the tab portion is illuminated, informing a user of a predetermined condition of the ink container, for example, that the amount of the ink remainder in the ink container fell below the critical value. In the case of an ink jet recording apparatus employs multiple liquid containers, the tab portion of only the liquid container in the predetermined condition can be illuminated. Further, a part, or parts, of each liquid storage container itself are utilized to illuminate the tab portion, making it possible to simplify the structural arrangement for illuminating the tab portion.

These and other objects, features, and advantages of the present invention will become more apparent upon consideration of the following description of the preferred embodiments of the present invention, taken in conjunction with the accompanying drawings.

BEST MODE FOR CARRYING OUT THE INVENTION

Hereinafter, the preferred embodiments of the present invention will be described in detail with reference to the appended drawings.

Embodiment 1

Figure 1:
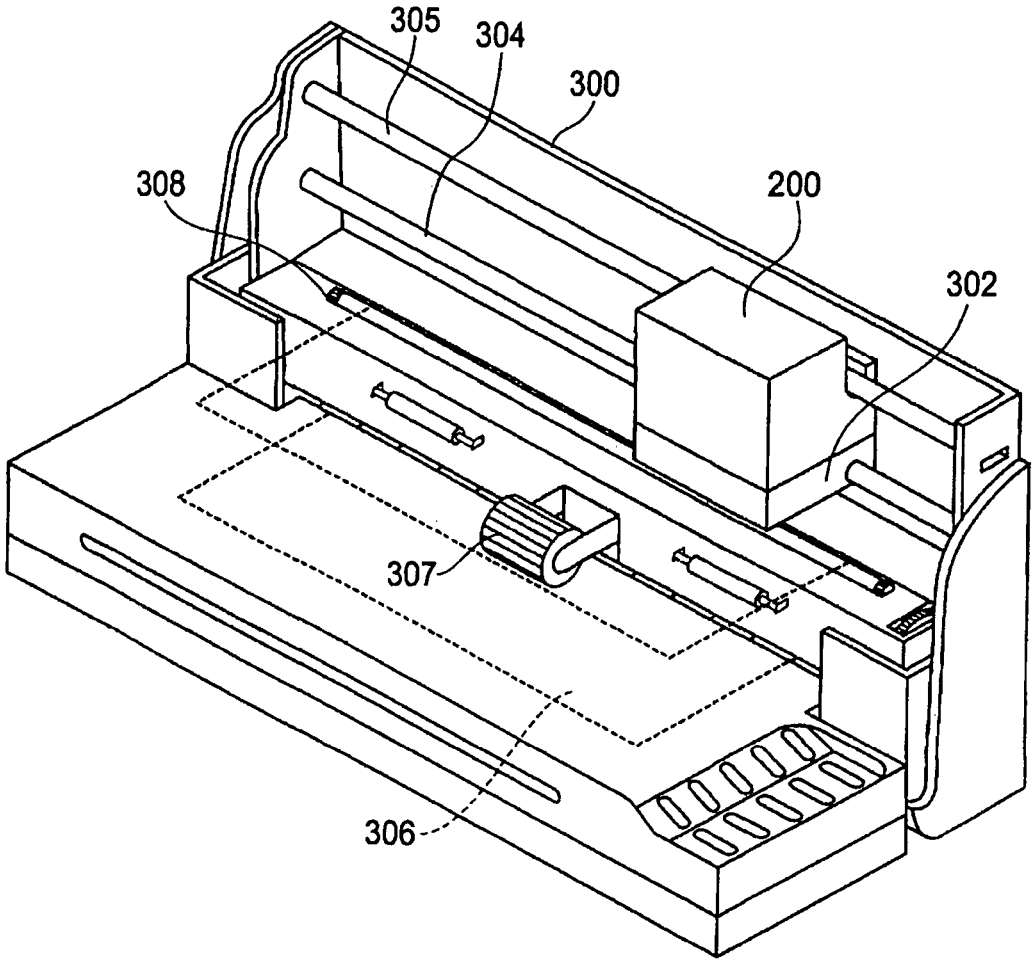
FIG. 1 is a schematic perspective view of the ink jet printer in the first embodiment of the present invention, showing the essential portions thereof.

FIG. 1 is a perspective view of the printer in the first embodiment of the present invention, as an image forming apparatus in accordance with the present invention. The ink jet printer 300 shown in FIG. 1 has a lead screw 304 and a guiding shaft 305, which are attached to the boxy frame of the printer, in parallel to each other. The printer 300 is also provided with an ink container holder 200 by which a recording head and multiple ink container storing inks to be supplied to the recording head are removably held. The holder 200 is movably attached to the lead screw 304 and guiding shaft 305. More specifically, the holder 200 is removably mounted on a carriage 302, which is movably mounted on the lead screw 304 and guiding shaft 305 so that the carriage 302 can be moved by rotating the lead screw 304 with the driving force from a motor (unshown). In other words, as the carriage 302 is moved, the holder 200 is moved. As the holder is moved, the recording head scans the surface of a recording medium such as a sheet of recording paper while ejecting ink. As a result, an image is recorded on the recording medium.

The printer 300 is structured so that recording medium is conveyed through the printer in the direction perpendicular to the direction in which the recording head scans the surface of the recording medium. The printer is provided with a sheet feeding roller 307 which conveys a recording sheet 306 to the area in which the recording sheet 306 as the recording medium is scanned by the recording head. The sheet feeding roller 307 is disposed on the upstream side of the scanning area in terms of the direction in which the recording sheet 306 is conveyed. The printer is also provided with a pair of sheet discharging rollers 308 for discharging recording paper 306 after the image forming scanning of the recording paper 306 by the recording head. The sheet discharging rollers 308 are on the downstream of the scanning area. The sheet feeding roller 307 and these sheet discharging rollers 308 are rotated by an unshown motor.

To describe in more detail the process for forming an image on the recording paper 306, as the recording head is scanning the surface of the recording paper 306, the ink droplets ejected from the recording head land on the surface of the recording paper 306, which is facing the recording head. As a result, an image is formed on the surface of the recording paper 306. More specifically, the process of causing the recording head to scan the surface of the recording paper 306 in the direction perpendicular to the direction in which the recording paper 306 is conveyed, and the process of conveying the recording paper 306 a predetermined distance by the sheet feeding roller 307 and sheet discharging rollers 308, are alternately repeated. As a result, an image is gradually formed across the surface of the recording paper 306.

Next, the structural arrangement in the first embodiment of the present invention, for informing a user of the amount of the ink remaining in each of the ink containers in the above described ink jet printer will be described.

Figure 2:
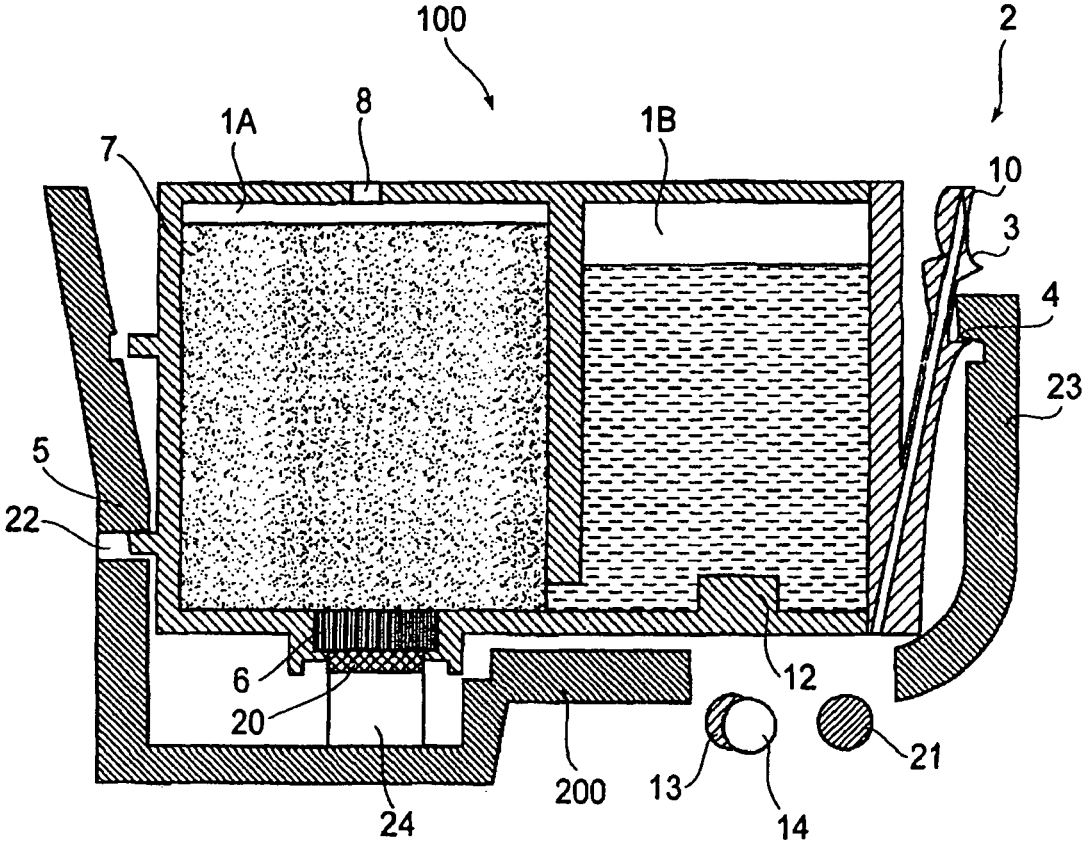
FIG. 2 is a schematic sectional view of the ink container holder, and the ink container therein, in the first embodiment of the present invention.
Figure 3:
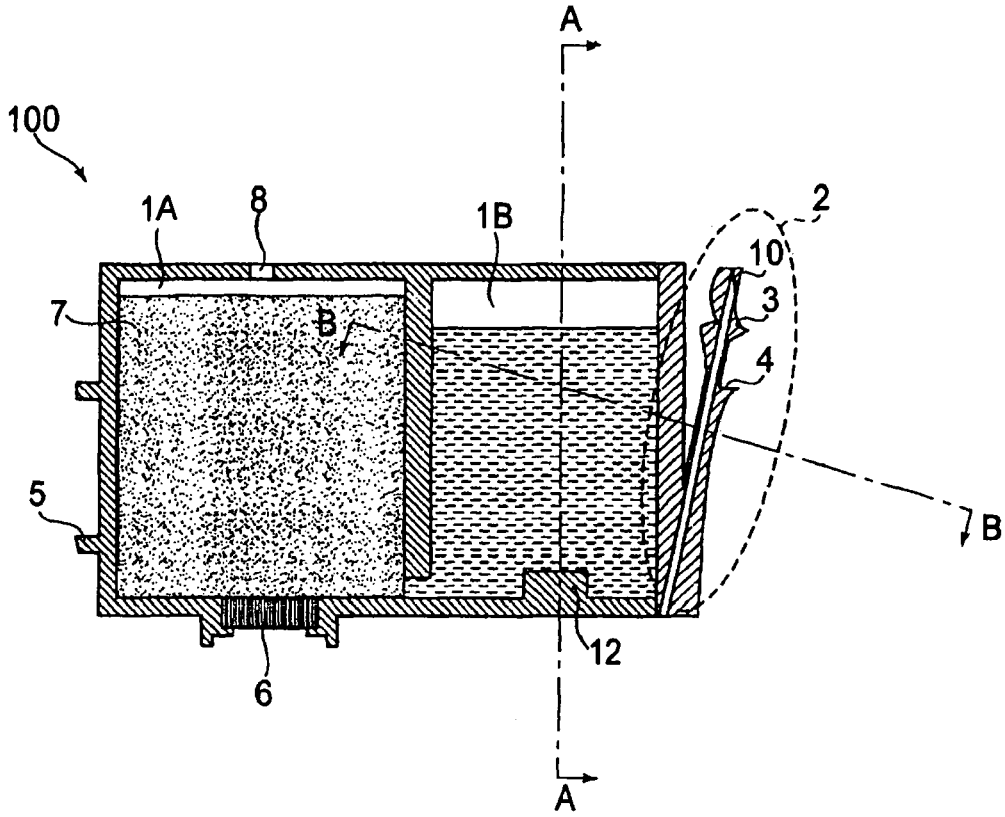
FIG. 3 is a schematic sectional view of the ink container shown in FIG. 2, showing the general structure thereof.
Figure 4:
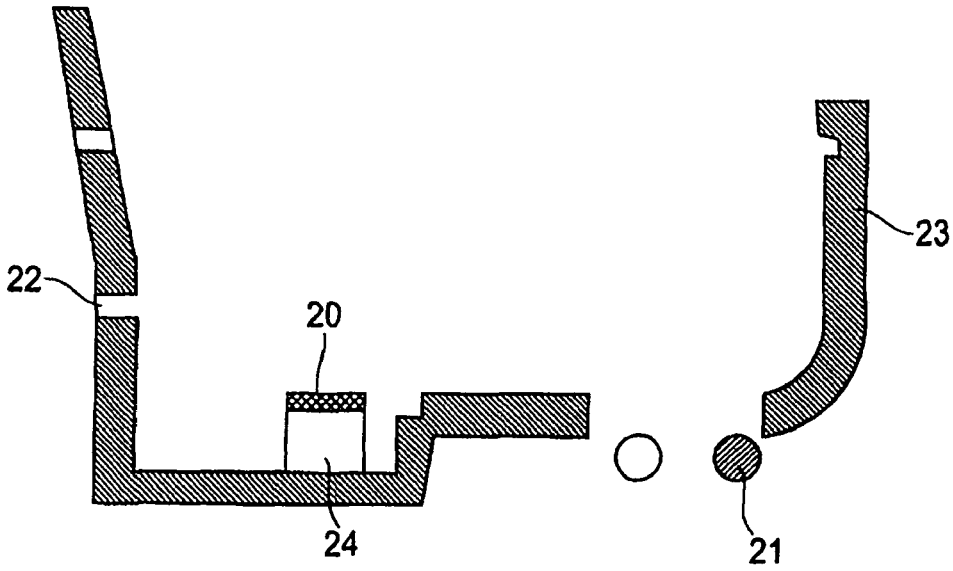
FIG. 4 is a schematic sectional view of the holder shown in FIG. 2, showing the general structure thereof.

FIG. 2 is a sectional view of the holder 200, and the ink container 100, as a liquid storage container, in the holder 200. FIG. 3 is a sectional view of the ink container 100 shown in FIG. 2, showing the general structure thereof. FIG. 4 is a sectional view of the holder 200 shown in FIG. 2, showing the general structure thereof.

As described above, the ink container 100 is removably mounted in the holder 200, and stores the ink to be supplied to the recording head. More specifically, referring to FIG. 2, in order to properly mount the ink container 100 into the holder 200, first, the ink container positioning (locking) projection 5 of the ink container 100 is to be fitted into the ink container positioning hole 22 (recess) of the holder 200. Then, the ink container 100 is to be pushed into the holder 200 in a manner of rotating the ink container about the abovementioned projection 5 of the ink container 100, to complete the process of mounting the ink container 100 into the holder 200. Toward the end of the rotation of the ink container 100, the ink outlet 6 of the ink container 100 engages with the ink supply passage 24 of the holder 200. Also toward the end of the rotation of the ink container 100, the lever 2 of the ink container 100 elastically bends, allowing its claw 4 to engage into the lever locking hole 23 (recess) of the holder 200, so that the ink container 100 is secured to the holder 200.

Further, toward the end of the mounting of the ink container 100 into the holder 200, the positional relationship between the light emitting member 21, such as an LED, and the light path 10, with which the lever 2 of the ink container 100 is provided, becomes such that the portion of the lever 2 where the finger is placed to manipulate the lever 2 (which hereinafter will be referred to simply as tab portion) can be illuminated by the light from the light emitting member 21. The light source 13 and sensor 14 are on the main assembly side of the printer, and are located at a predetermined point in the moving range of the holder 200, so that as the holder 200 is moved to a point corresponding to the abovementioned predetermined point, the positional relationship among the light source 13, sensor 14, and the prism 12 of the ink container 100, becomes such that the amount of the ink remainder in the ink container 100 can be detected by them.

Ink Container Structure (Internal)

Referring to FIGS. 2 and 3, the ink container 100 comprises liquid storage portions 1A and 1B. The liquid storage portion 1A contains an absorbent member 7 which retains ink 11. The liquid storage portion 1B stores only ink 11. The two ink storage portions 1A and 1B are connected to each other through a passage located next to the bottom wall of the ink container 100. To describe in more detail, as the ink in the liquid storage portion 1A is consumed for recording, the ink in the liquid storage portion 1B enters the liquid storage portion 1A while air enters the liquid storage portion 1B, through the abovementioned passage; the ink in the liquid storage portion 1B is exchanged with the air in the liquid storage portion 1A. Further, as the air in the liquid storage portion 1A is exchanged with the ink in the liquid storage portion 1B, the ambient air is taken into the liquid storage portion 1A through a vent 8 located in the top portion of the ink container 100. The ink container 100 is also provided with an ink outlet 6, which is attached to the bottom wall of the liquid storage portion 1A to supply the recording head with ink. As will be described later in more detail, the liquid storage portions 1A and 1B are the hollows of the ink container made by bonding multiple components formed of transparent plastic by injection molding. The reason for using transparent plastic as the material for the container is to optically detect the amount of the ink remainder in the container with the use of a prism. Incidentally, all the components of the ink container do not need to be formed of a transparent substance. Obviously, it is acceptable to form only the components through which light must be transmitted to or from the prism, of a transparent substance.

Further, the ink container 100 is provided with a prism 12 for detecting the amount of the ink 11 in the liquid storage portion 1B; the bottom wall of the liquid storage portion 1B of the ink container 100 is provided with the prism 12.

Ink Container Structure (External)

Referring to FIGS. 2 and 3, the ink container 100 is also provided with a lever 2 with a claw 4, and an engagement projection 5, which are for engaging the ink container 100 with the holder 200 as described before. The lever 2 is provided with a finger placement portion 3 (which hereinafter will be referred to simply as tab portion) where the finger (or thumb) of a user is to be placed during the mounting or removal of the ink container 100, and a light path 10 for guiding light from the bottom portion of the ink container 100 to the tab portion 3.

Holder Structure

The holder 200 is removably mountable on a carriage 302. Referring to FIGS. 2 and 4, the holder 200 is provided with an ink passage 24 for guiding ink from the ink outlet 6 of the ink container 100 to the recording head, and a filter 25 for preventing foreign matter from entering the ink passage 24 from outside. To the bottom wall of the holder 200, the recording head (unshown) is attached so that it connects to the ink passage 24. The holder 200 is also provided with ink container positioning (locking) holes 22 and 23 (recesses) into which the claw 5 and projection 5, respectively, of the ink container 100 engage to lock the ink container 100 to the holder 200 while accurately positioning the ink container 100 relative to the holder 200.

Further, the holder 200 is provided with multiple light emitting members 21, next to each of which one of the lengthwise ends of the corresponding light path 10 is disposed to guide the light emitted by the corresponding light emitting member 21.

As ink is ejected from the recording head, the ink 11 in the ink container 100 is consumed, and the amount of the ink remaining in the ink container 100 is checked with a predetermined timing (for example, every time a page, or a job, is completed). More specifically, in this embodiment, whether or not the amount of the ink remainder has fallen below a predetermined value is optically checked with the use of the prism 12. Incidentally, the amount of the ink remainder may be detected by one of the known methods other than the one employed in this embodiment. For example, the number of times ink is ejected may be counted and cumulatively stored in a storage medium such as a RAM, with which the main assembly of the printer, or the ink container 100, is provided, and the amount of the ink remainder may be calculated based on the cumulative ink ejection count. For greater accuracy, the ink remainder amount detecting method in this embodiment, which uses the prism 12, may be used in conjunction with this method of calculating the ink remainder amount based on the cumulative ink ejection count.

Detection of Out-of-Ink Condition by Prism

Figure 5:
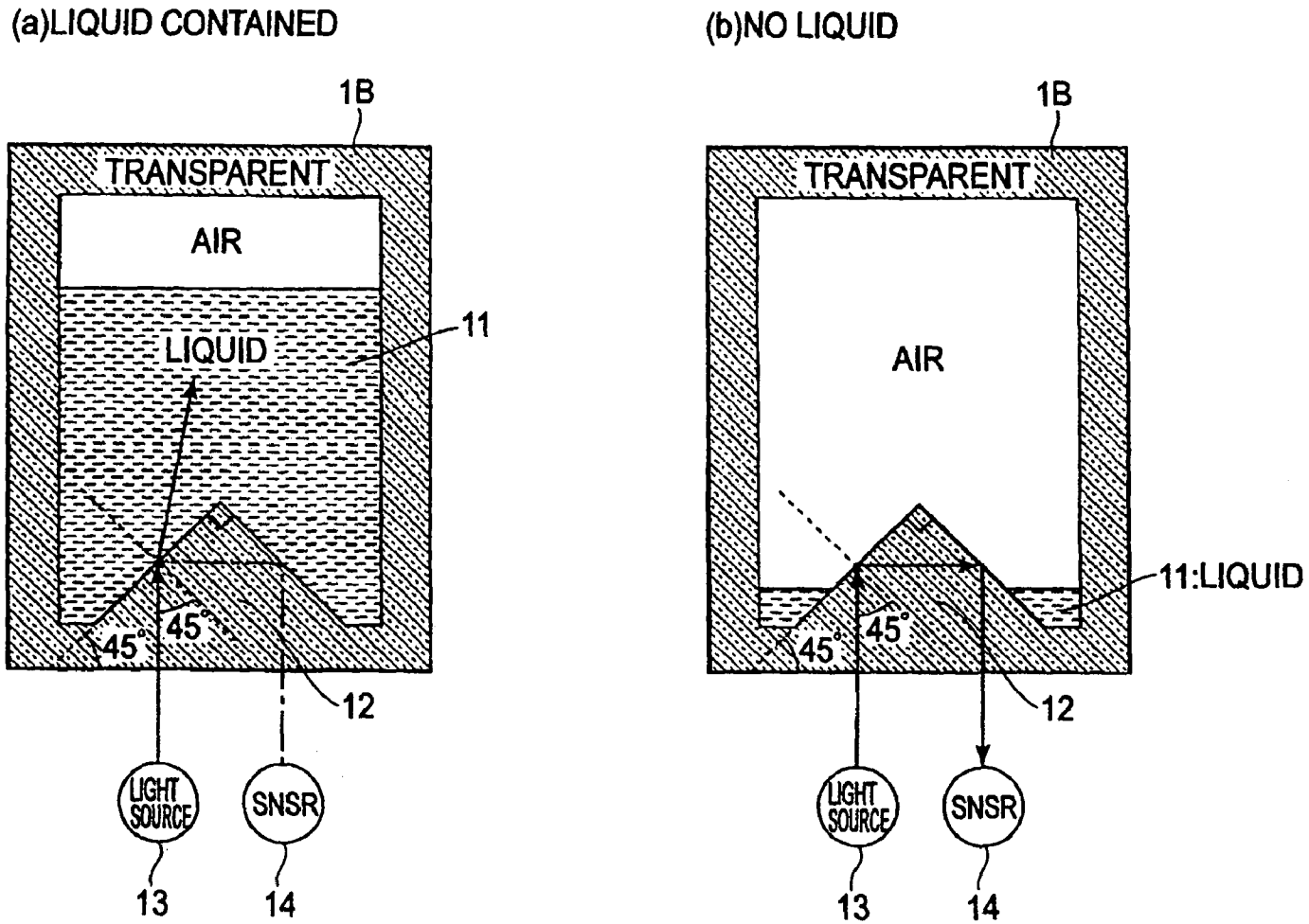
FIGS. 5(*a*) and 5(*b*) are sectional views of the prism, and its adjacencies, of the ink container shown in FIG. 2, involved in the detection of the amount of ink remainder in the ink container in the first embodiment.

FIGS. 5(*a*) and 5(*b*) are schematic sectional drawings of the ink container 100, at a plane A-A in FIG. 3, describing the principle, based on which the amount of the ink remainder is detected in this embodiment. FIG. 5(*a*) represents the case in which there remains a sufficient amount of ink in the ink container 100, and FIG. 5(*b*) represents the case in which the ink container 100 is out of ink (virtually out of ink).

In the drawings, n0 represents the index of refraction of air, and n1 represents the index of refraction of the material of the wall of the liquid storage portion 1B (incidentally, in FIG. 5, the wall is represented by a plain line, that is, the thickness of the wall of the ink container is not shown; however, the index of refraction of the wall of the liquid storage portion 1B, here, means the index of refraction of the wall with a certain value of thickness, and this is true with all drawings given hereafter). The index of refraction of the ink 11 is represented by n2, and angle of incidence of the light relative to the slanted face of the prism 12 is represented by θ1. The angle of the exit of the light exiting into air from the prism 12 through the slanted face of the prism 12 is represented with θ0. The angle of exit of the light exiting from the prism 12 into the ink 11 through the slanted face of the prism 12 is represented with θ2. Then, when the amount of the ink remainder is detected while the ink container 100 is in the condition shown in FIG. 5(*b*), that is, when the slanted face of the prism 12 is in contact with the air in the liquid storage portion 1B, because the amount of the ink remainder has dwindled to virtual zero, the following mathematic equation holds according to Snell laws of refraction:

$$n0 \cdot \sin \theta 0 = n1 \cdot \sin \theta 1$$

On the other hand, when the amount of the ink remainder is detected while the ink container 100 is in the condition shown in FIG. 5(*a*), that is, when the ink 11 is in contact with the slanted face of the prism 12 because there is a sufficient amount of ink in the ink container 100, there is the following relationship:

$$n2 \cdot \sin \theta 2 = n1 \cdot \sin \theta 1$$

Such a value of θ1 that makes the value of θ0 or θ2 90°, is called "critical angle" of refraction. When the angle of incidence is greater than the critical angle of refraction, the incident light is reflected in its entirety. Therefore, it is possible to select the material for the liquid storage portion 1B, and to set the angle of the slanted face of the prism 12 and the angle of incidence of the light to proper values, in accordance with the index of refraction of the ink 11, so that virtually no part of the incident light reach the photosensor 14. Further, when there is virtually no ink 11 in the ink container 100, the incident light is reflected by the interface between the slanted face of the prism 12 and the air in the liquid storage portion 1B. Therefore, the incident light can be detected by the photosensor 14.

In this embodiment, the angle of the slanted face of the prism 12 is 45°, and the angle of incidence is also 45°. Further, the ink 11 is a water-based ink, ink which uses water as solvent, or the like, and is 1.32 in index of refraction, and the material for the wall of the liquid storage portion 1B is polypropylene, and is 1.50 in index of refraction. In this case, the critical angle of refraction of the light entering the air in the liquid storage portion 1B through the slanted face of the prism 12, that is, from the material of the wall of the liquid storage portion 1B, is 41.8°, and the critical angle of refraction of the light entering the liquid 11 in the liquid storage portion 1B through the slanted face of the prism 12 is 62.0°. The angle of incidence (45°) of the incident light is greater than 41.8°. Therefore, when there is a sufficient amount of ink 11 in the liquid storage portion 1B as shown in FIG. 5(*a*), it does not occur that the incident light is entirely reflected, and therefore, is not detected by the photosensor 14, whereas when there is virtually no ink 11 in the liquid storage portion 1B as shown in FIG. 5(*b*), the incident light is reflected in its entirety, and therefore, is detected by the photosensor 14, because the angle (45°) of the incidence of the incident light is smaller than 62.0°.

As the control portion of the main assembly of the printer detects, based on the above described principle, that the liquid storage portions 1B and 1A have run out of the ink 11, it informs the user, through the host computer, that the ink container 100 is in the "out-of-ink" condition, suggesting thereby that the user of the printer replaces the ink container 100.

Figure 6:
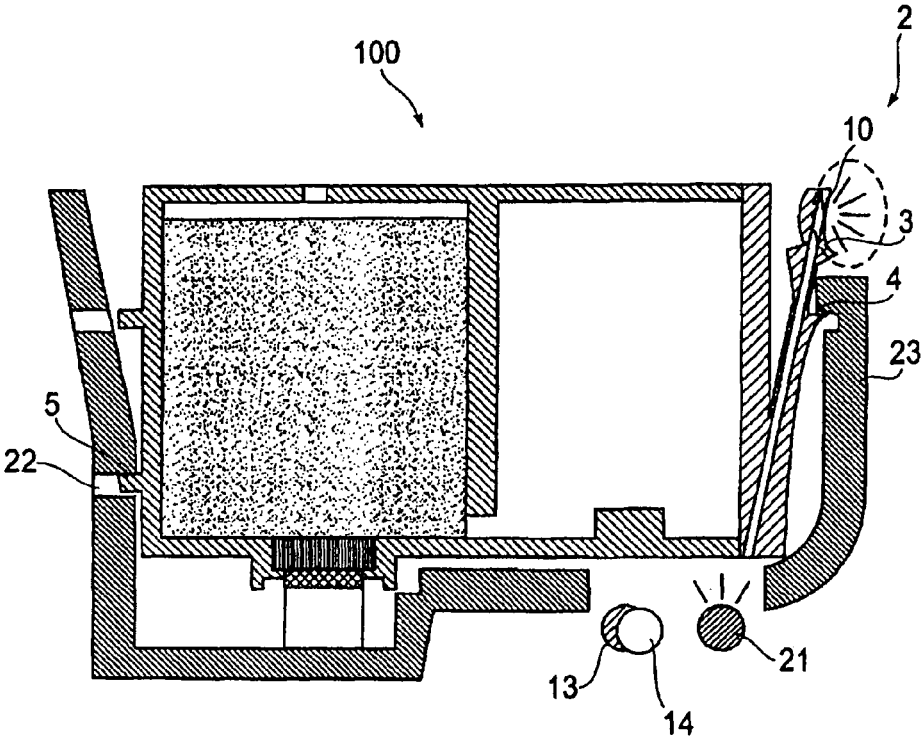
FIG. 6 is a schematic sectional view of the ink container holder, and the ink container therein, in the first embodiment of the present invention, showing the structural arrangement for illuminating the tab portion of the ink container as it is detected that the amount of the ink remainder in the ink container has fallen below the predetermined value.
Figure 7:
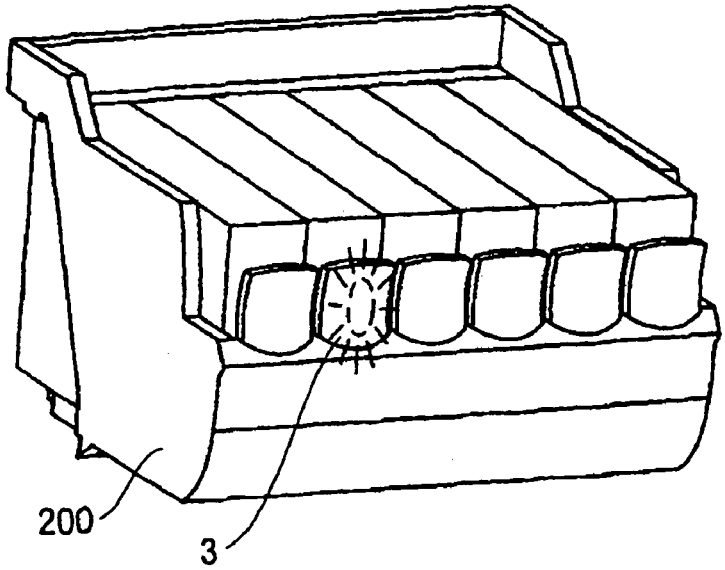
FIGS. 7(*a*) and 7(*b*) are perspective and side views of the ink container holder and the ink containers therein, showing that the tab portion of one of the ink container is being illuminated because it has been detected that the amount of the ink remainder in this ink container fell below the predetermined value.
Figure 7:
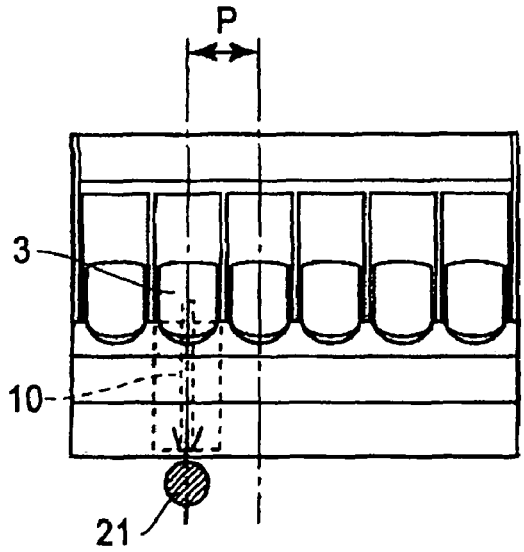

As the same time, the control portion turns on the light emitting member 21 which corresponds to the ink container, the "out-of-ink" condition of which has just been detected, as shown in FIG. 6. As a result, the light emitted from the light emitting member 21 reaches the tab portion 3 of the lever 2 through the light path 10 in the lever 2, illuminating the tab portion 3, as shown in FIGS. 7(*a*) and 7(*b*).

Since the tab portion 3 itself of the lever 2 of the ink container 100 which is to be replaced is illuminated, a user can determine at a glance which ink container 100 is to be replaced. Further, the user can determine which portion of the ink container 100 to be replaced, is to be manipulated to remove the ink container 100. In other words, a part, or parts, of an ink container itself are utilized as the displaying means for informing a user whether or not a given ink container is to be replaced. Therefore, the structural arrangement, in this embodiment, for determining whether or not a given ink container is out of ink, and also, for informing a user of the predetermined condition of the given ink container, is very simple.

Figure 8:
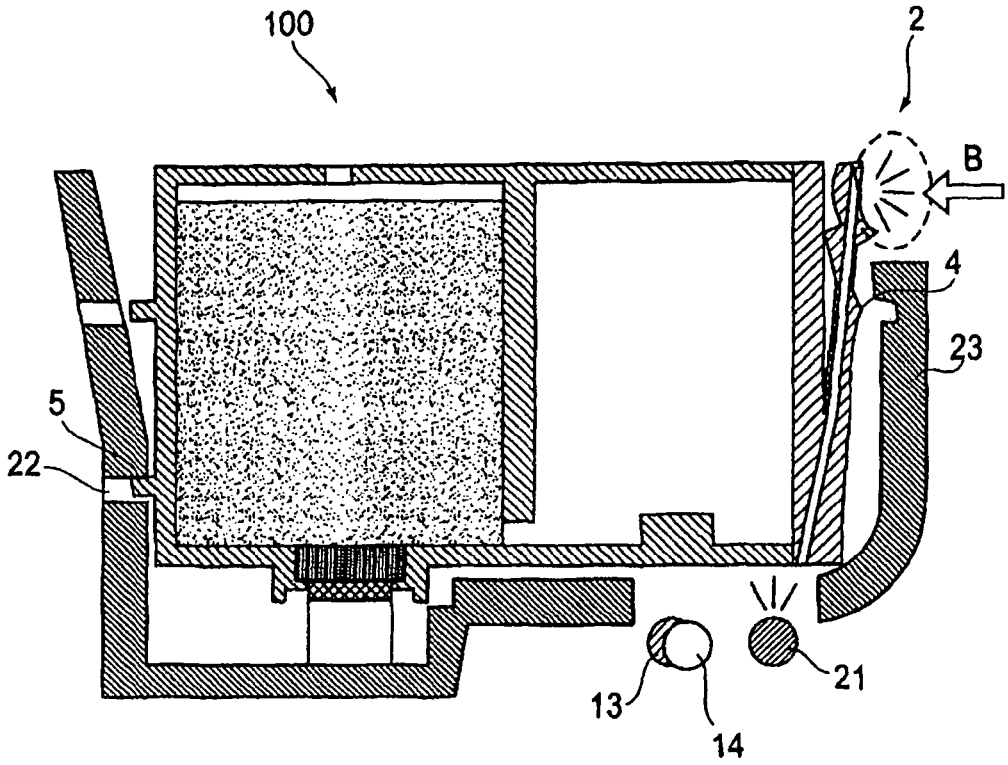
FIG. 8 is a schematic sectional drawing describing the procedure for removing the ink container in the first embodiment of the present invention.
Figure 9:
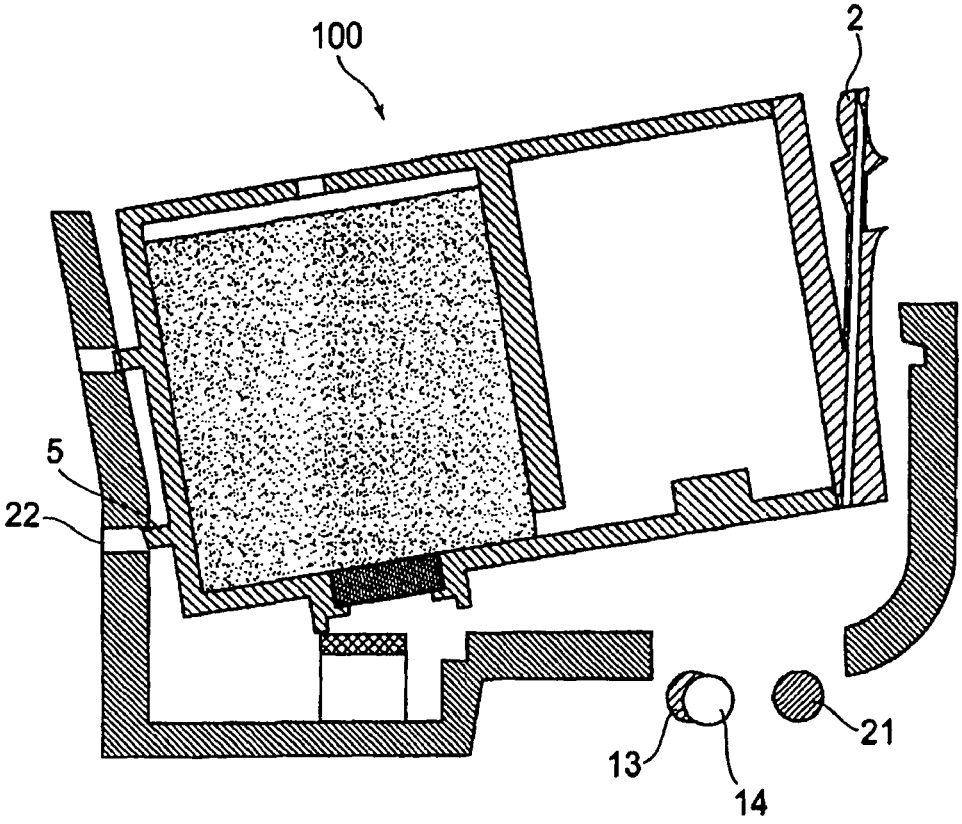
FIG. 9 is a schematic sectional drawing describing also the procedure for removing the ink container in the first embodiment of the present invention.

Referring to FIG. 8, as the illuminated tab portion 3 of the lever 2 of the ink container 100 is pressed by a user in the direction indicated by an arrow mark B, the claw 4 of the lever 2, which has kept the ink container 100 locked to the holder 200, becomes disengaged from the ink container positioning (locking) hole 23 (recess) of the holder 200. Next, the ink container 100 is to be rotated upward about the contact point between the ink container positioning (locking) projection 5 and the edge of the hole 22, as shown in FIG. 9, so that the ink container 100 comes out of the holder 200. This ends the procedure for removing the ink container 100.

Light Path 10

Figure 10:
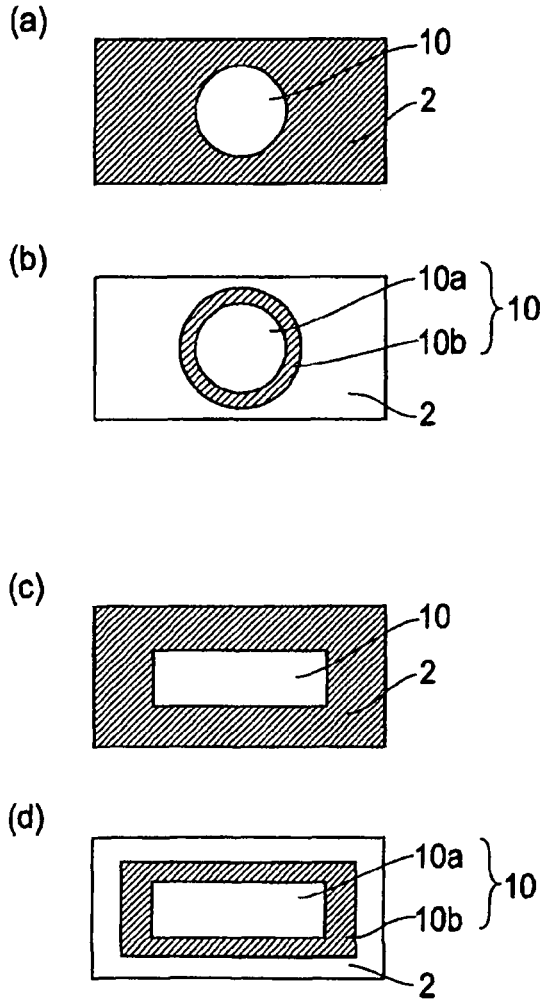
FIGS. 10(*a*)-10(*d*) are sectional drawings describing the laminar structure of the light path.
Figure 11:
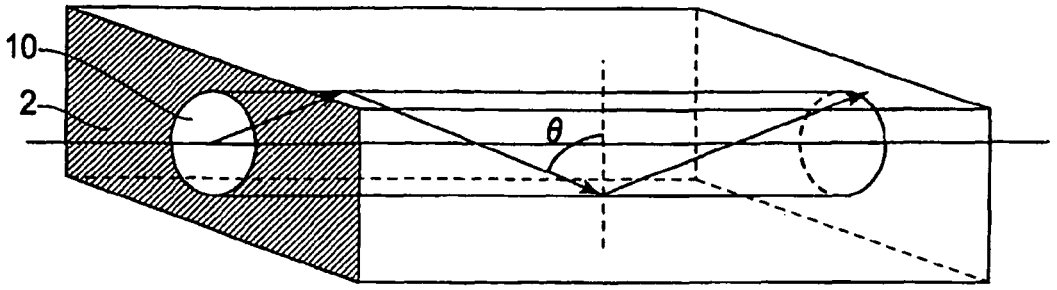
FIG. 11 is a perspective phantom view of the light path, depicting the transmission of the light through the light path.

Next, referring to FIGS. 10(*a*)-10(*d*), and FIG. 11, the details of the light path 10 will be described. FIGS. 10(*a*)-10(*d*) are sectional views of various examples of the light path 10 in the lever 2, at a plane B-B in FIG. 3. FIG. 11 is a schematic phantom perspective view of the portion of the lever 2, which has the light path 10, showing how the light is reflected after entering the light path 10 shown in FIG. 10.

For the purpose of efficiently illuminating the tab portion 3 of the lever 2, it is desired to employ one of the structural arrangements shown in FIGS. 10(*a*)-10(*d*). In the case of the examples of the light path 10 shown in FIGS. 10(*a*) and 10(*c*), the light path 10 is formed of a substance, such as the material for the core portion of an optic fiber, which is high in index of refraction, whereas the primary portion of the lever 2, which surrounds the light path 10, is formed of a substance such as the clad portion of optic fiber, which is lower in index of refraction than the core portion of the optic fiber. In this case, as the light entering the light path 10 at the light emitting member side travels through the light path 10 to the tab portion 3 of the lever 2, that is, the opposite side of the light path 10, it is repeatedly reflected in its entirety by the interface between the light path 10, and the primary portion of the lever 2 surrounding the light path 10, being therefore minimized in loss. Thus, the light emitting member 21 is not required to emit a large amount of light.

In the case of the examples of the light path 10 shown in FIGS. 10(*b*) and 10(*d*), the light path is an integration of a core portion and a clad portion; in other words, the light path is identical to ordinary optic fiber. The portions 10*a* shown in FIGS. 10(*b*) and 10(*d*), which are equivalent to the core portion of optic fiber, are formed of a substance such as the material for the core portion of optic fiber, which is high in index of refraction, whereas the portions 10*b* shown in FIGS. 10(*b*) and 10(*d*), which surround the portions 10*a* are formed of a substance such as the material for the clad portion of optic fiber, which is lower in index of refraction than the core portion. In this case, it is unnecessary to take into consideration the index of refraction of the substance used as the material for the primary portion of the lever 2, affording more latitude in designing the ink container 100. The lever 2 is required to have a certain amount of resiliency. Therefore, in case it is difficult to obtain a substance which can function as the clad portion of the light path 10 while providing the lever 2 with a satisfactory amount of resiliency, these examples of light path 10 shown in FIGS. 10(*b*) and 10(*d*) become preferable choices.

Basic Concept of Photoconductive Wave Phenomenon

Next, referring to FIG. 11, how the light travels through the light path 10 in the lever 2, described with reference to FIGS. 10(*a*)-10(*d*), will be described. FIG. 11 is a schematic phantom perspective view of the light path 10 and its adjacencies shown in FIG. 10(*a*).

As described above, when the angle of incidence of the light entering the interface is no more than the critical angle of refraction of the interface, the so-called total reflection occurs; the light is extremely efficiently reflected. This is the phenomenon used to transmit the light through the light path 10 in the lever 2. When the light enters the primary portion of the lever 2 from the light path 10 (in this case, there is the following relationship: n2>n3, n2 and n3 being index of refractions of light path 10 and the primary portion of the lever 2, respectively), the light is totally reflected as long as the angle of incidence of the light is greater than the critical angle θ of refraction, which satisfies:

$$\sin\theta = n3/n2.$$

When a flux of light is totally reflected, the entire energy of the flux is reflected. Therefore, a flux of light transmits through a light path without attenuating (total reflection), as shown in FIG. 10(*a*), provided that the following conditions are met: light transmission medium (core) which is high in index of refraction is surrounded with a medium (clad), that is, the primary portion of the lever 2, which is low in index of refraction; and the flux of light is introduced into the core at an angle (angle of incidence) greater than the critical angle of refraction. This phenomenon is called photoconductive wave phenomenon, and an element through which a flux of light can be transmitted based on the photoconductive wave phenomenon is referred to as photoconductive wave path. In other words, the combination of the light path 10 and the primary portion of the lever 2, shown in FIGS. 10(*a*) and 10(*c*), and the combination of the light paths 10*a* and 10*b*, shown FIGS. 10(*b*) and 10(*d*), are light photoconductive paths.

The components of the lever 2 shown in FIG. 10(*a*) and the corresponding components of the lever 2 shown in FIG. 10(*c*) are the same in function. The light paths 10 shown in FIGS. 10(*a*) and 10(*c*) are the same in function as the core portions 10*a* of the light paths shown in FIGS. 10(*b*) and 10(*d*). Further, the primary portions of the levers 2 shown in FIGS. 10(*a*) and 10(*c*) are the same in function as the clad path portions 10*b* of the light paths shown in FIGS. 10(*b*) and 10(*d*). Thus, not only are the above subjects described with reference to FIG. 11 applicable to the lever 2 shown in FIG. 10(*a*), but also, the levers 2 shown in FIGS. 10(*b*), 10(*c*), and 10(*d*).

Next, the cross-sectional shapes of the portion of the lever 2, which is equivalent to the core portion of optic fiber, and the primary portion of the lever 2, which is equivalent to the clad portion of optic fiber, will be described while comparing the levers 2 shown in FIGS. 10(*a*) and 10(*b*) to the levers 2 shown in FIGS. 10(*c*) and 10(*d*).

If the light emitted from the light source 21 is diffusive, the light paths shown in FIGS. 10(*a*) and 10(*b*) are smallest in the amount by which the light emitted from the light source 21 attenuates, because the light paths are circular in cross section, causing thereby the light to be reflected in its entirety regardless of angle. However, the gist of the present invention is that the tab portion of the lever 2 is selectively illuminated. Therefore, the present invention is also compatible with an ink container, such as those shown in FIGS. 10(*c*) and 10(*d*), the light path portion of the lever 2 of which is rectangular in cross section, and also, with an ink container, the light path portion of the lever 2 of which has a cross-sectional shape other than a circle or rectangle.

Materials

As the materials for the light path 10 and the primary portion of the lever 2, plastics, quartz, glasses, etc., are used. Where PMMA (acrylic, polymethyl methacrylate) is used as the material for the core portion, a fluorinated resin is used as the material for the sheath (clad) portion. For example, copolymer of PTFE (polytetrafluoroethylene) and vinylidene fluoride, copolymer of methacrylate fluoride and MMA (methyl methacrylate), or the like, is used as the material for the clad portion of the light path 10.

When acrylic, which is an ordinary plastic, is used as the material for the core portion (light path 10), all that is necessary to cover the core portion with a substance, the index of refraction of which is smaller than the index of refraction (nD) of acrylic, which is 1.49. The chemical structure of acrylic is such that acrylic itself functions as a photoconductive wave path when surrounded with air. Thus, when acrylic is used as the material for the core portion, all that is necessary to do is to surround the core portion with a body of air; it is unnecessary to coat the core portion with a substance other than the material for the core portion. For example, a photoconductive wave path can be easily formed by making hollow the portions 10*b* shown in FIGS. 10(*b*) and 10(*d*). Further, instead of making the light path 10 different in material from the primary portion of the lever 2, which covers the light path 10, the lever 2 may be designed so that the lever 2 itself functions as the light path 10. In such a case, the layer of air surrounding the lever 2 plays the role of the clad, and this kind of air layer is called air clad.

Embodiment 2

In this embodiment of the present invention, which also relates to the ink remainder amount detection and the structural arrangement for indicating the ink container to be replaced, by guiding the light emitted by a light emitting member to the tab portion of the lever 2, the light path is provided with a switching element so that only a single light emitting member is required to illuminate the tab portion of a specific ink container among multiple ink containers. Hereinafter, descriptions will be concentrated on the differences of the second embodiment from the first embodiment, and the portions similar to those in the first embodiment will not be described.

Figure 12:
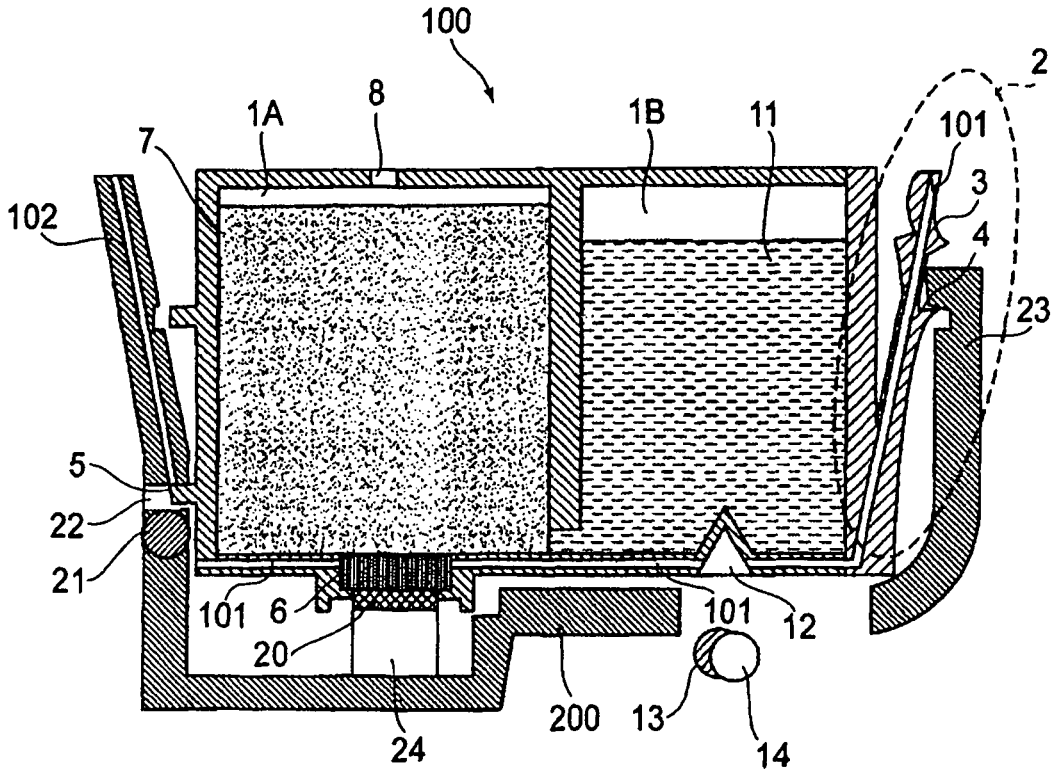
FIG. 12 is a schematic sectional view of the ink container holder and the ink container therein, in the second embodiment of the present invention.
Figure 13:
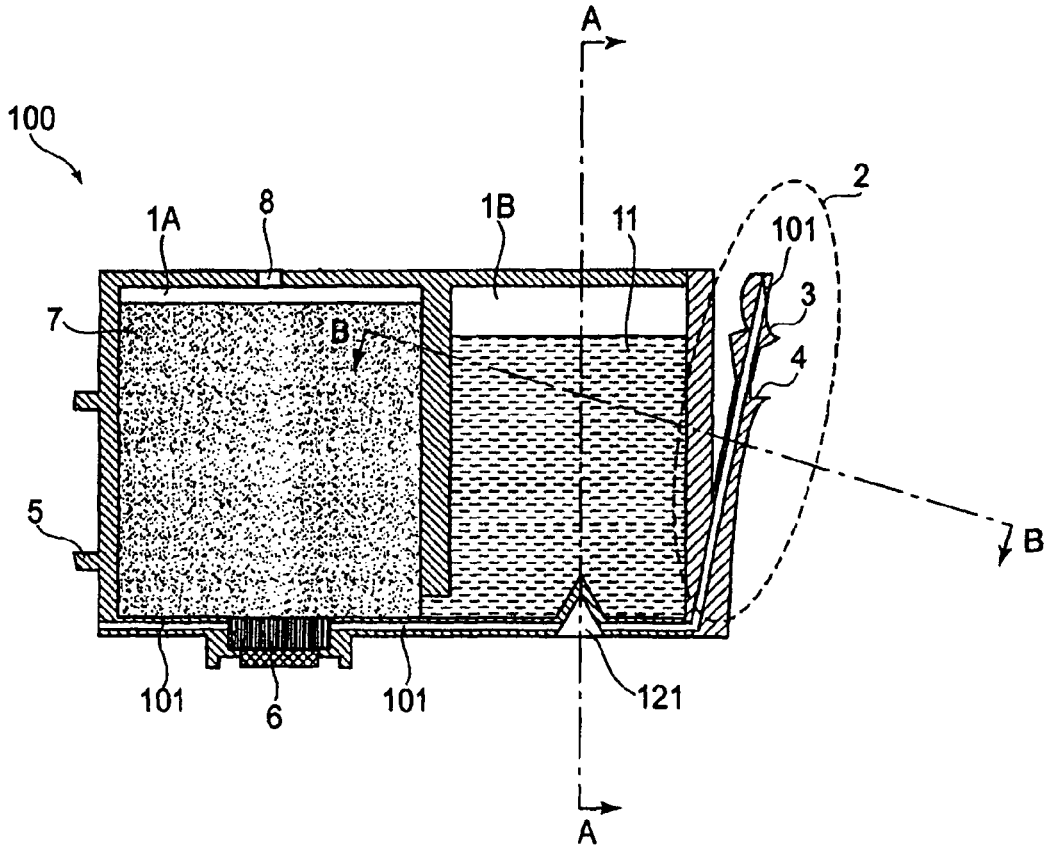
FIG. 13 is a schematic sectional view of the ink container shown in FIG. 12, showing the general structure thereof.

FIG. 12 is a sectional view of the holder 200 and the ink container 100 held therein, in this embodiment. FIG. 13 is a sectional view of the ink container 100 in this embodiment.

As shown in these drawings, the holder 200 is provided with a light emitting member 21, which is disposed on the side (rear side) opposite from where the lever 2 of the ink container 100, which is manipulated by a user when the ink container is mounted, will be after the mounting of the ink container 100 into the holder 200. Because of this positioning of the light emitting member 21, the light path 101 of the ink container 100 is extended from one end (rear) of the ink container 100 to the other (front) through the bottom wall of the ink container 100, and then, to the tab portion 3 of the lever 2, as is the light path 10 in the first embodiment. Further, this light path 101 is routed so that the portion of the light path 101, which overlaps with the ink outlet 6 in FIG. 2, goes around the outlet 6. Moreover, the portion of the light path 101 in the bottom portion of the liquid storage portion 1B, is provided with an optical switch 121 for detecting the amount of the ink remainder in the liquid storage portion 1B. Not only does this optical switch 121 function as an optical switch, but also, plays the same role as the role of the prism 12 in the first embodiment, as will be described hereinafter. As for the holder 200, it is provided with a second light path 102, which will be described with reference to FIG. 18 and thereafter.

Figure 14:
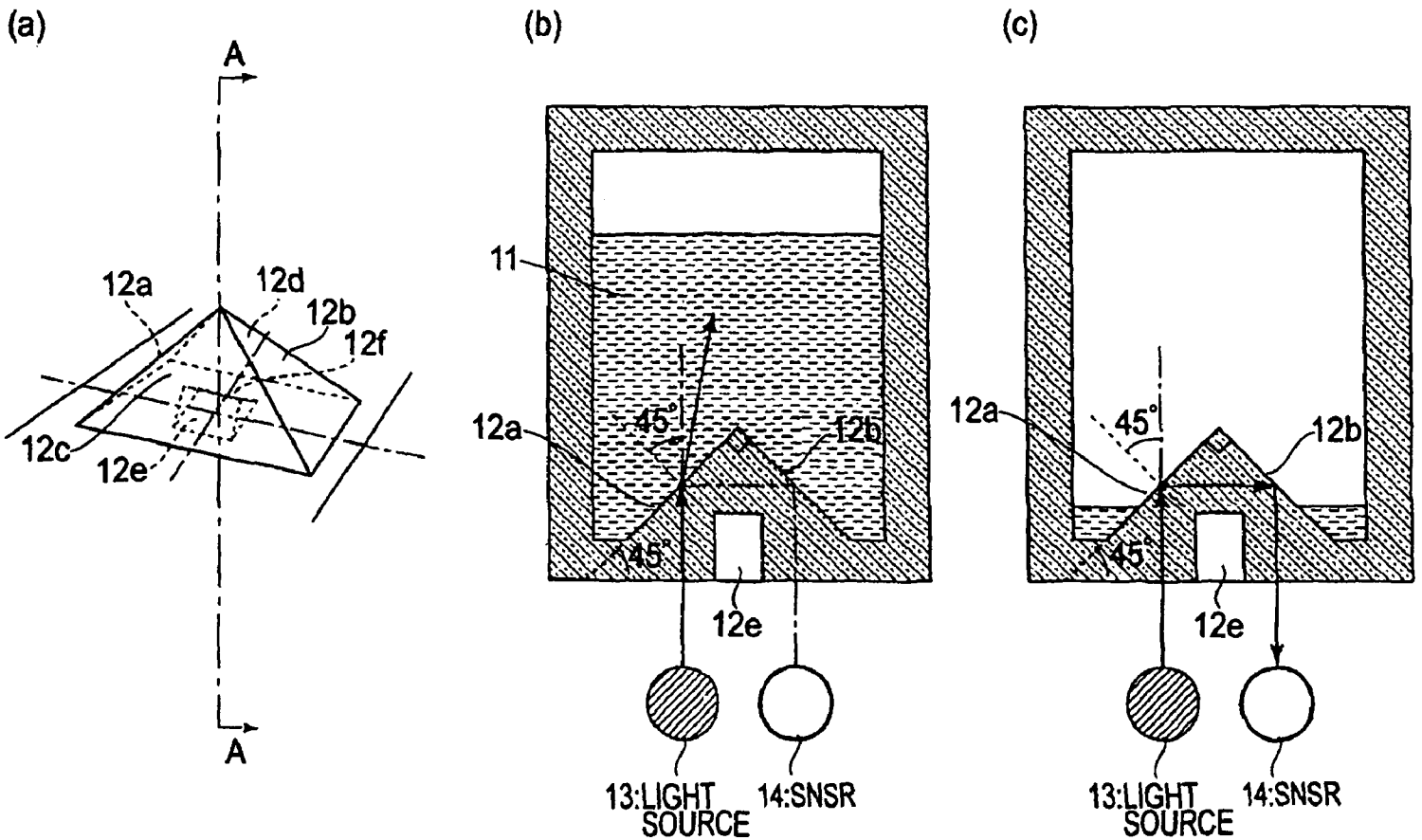
FIGS. 14(*a*)-14(*c*) are drawings for describing the operation of the optical switch, in the second embodiment of the present invention, in particular, the operation for detecting the ink remainder amount.

FIG. 14(*a*) is a drawing for describing the details of the optical switch 121. The slanted faces 12*a*, 12*b*, 12*c*, and 12*d* of the prism 12 in the form of a pyramid, in this embodiment, are parts of the ink container 100 as are the slanted faces of the prism 12 in the first embodiment. This prism 12 in the form of a pyramid is provided with a hollow in the form of a prism, which has the slanted faces 12*e* and 12*f*. This hollow having the slanted faces 12*e* and 12*f* is identical in shape to the prism 12 in the first embodiment; slanted faces 12*e* and 12*f* are formed of the same material as the material for the ink container 100.

How the amount of the ink remainder is detected by the above described optical switch 121 is the same as that in the first embodiment. In other words, the carriage is moved to the location at which the light source 13 and sensor 14 align with a targeted ink container, and then, the light source 13 is turned on.

FIGS. 14(*b*) and 14(*c*) are drawings which show the relationship between the path of the light emitted from the light source 13 and the amount of the ink remainder. In other words, they are equivalent to FIGS. 5(*a*) and 5(*b*) related to the first embodiment. In this embodiment, the amount of the ink remainder is detected through the coordination among the slanted faces 12*a* and 12*b* of the optical switch 121, light source 13, and sensor 14. The principle therefor is the same as that given in the description of the first embodiment with reference to FIGS. 5(*a*) and 5(*b*), and therefore, will not be described.

Figure 15:
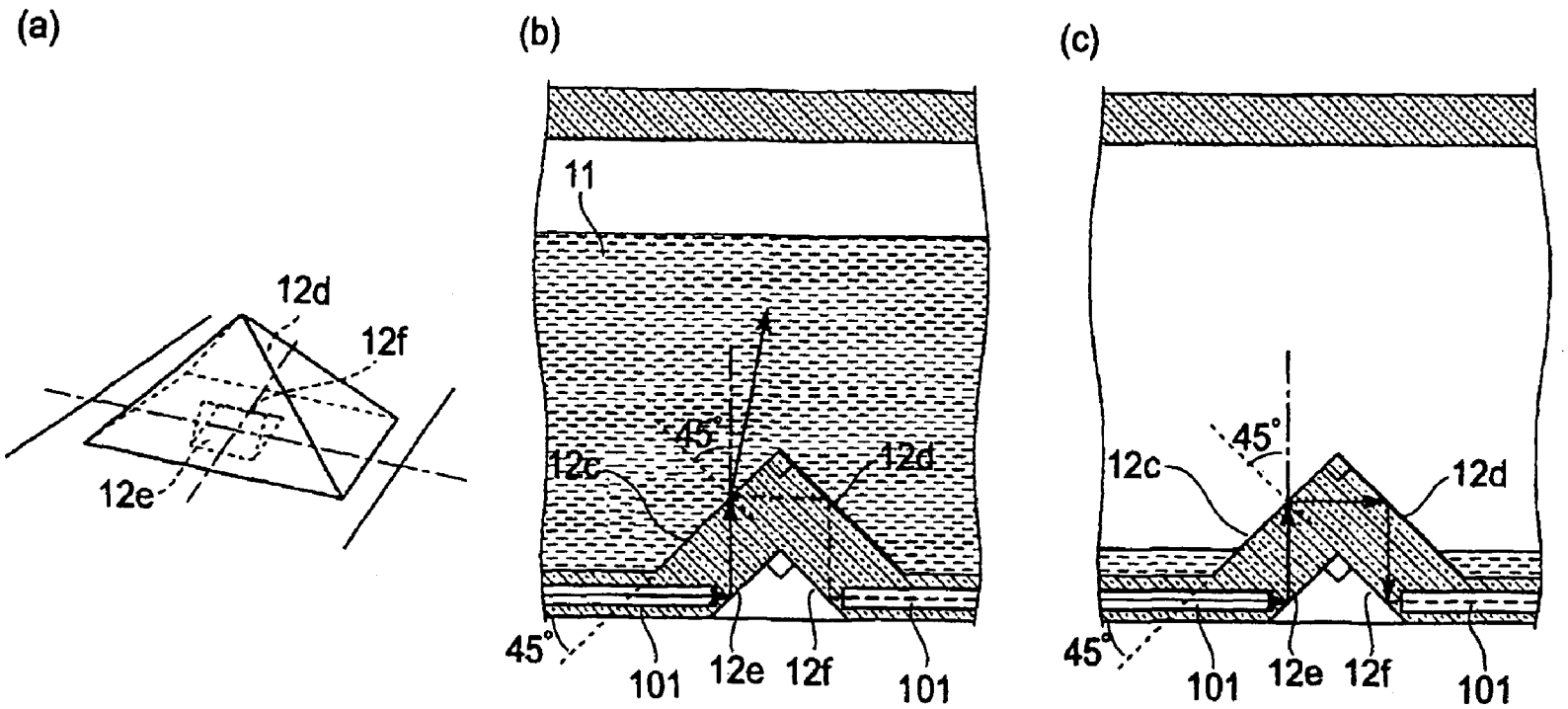
FIGS. 15(*a*)-15(*c*) are drawings for describing the operation of the optical switch in the second embodiment of the present invention, in particular, the completion of the light path.

FIGS. 15(*a*)-15(*c*) are drawings for describing the switching function of the optical switch 121. Referring to FIG. 15(*a*), the switching function of this optical switch 121 is provided by the slanted faces 12*c* and 12*d* of the prism 12, which are perpendicular to the slanted faces 12*a* and 12*b* used for the abovementioned detection of the ink remainder amount, and the slanted faces 12*e* and 12*f* of the prism 12.

FIGS. 15(*b*) and 15(*c*) show how the presence of a sufficient amount of ink, and the out-of-ink condition, are detected, respectively.

Referring to FIG. 15(*b*), in which n0 represents the index of refraction of air; n1 represents the index of refraction of the material of the wall of the liquid storage portion 1B; θ1 represents the angle of incidence of the light relative to the slanted face 12*e* of the prism 12; and θ0 represents the angle (angle of exit) at which a flux of light exits into air through slanted face 12*e* of the prism 12, there is the following relationship, according to Snell laws of refraction, because the slanted surface 12*e* is in contact with air:

$$n0 \cdot \sin \theta 0 = n1 \cdot \sin \theta 1.$$

Such a value of θ1 that makes the value of θ0 or θ2 90°, is called "critical angle" of refraction. When the angle of incidence of the incident light is greater than the critical angle of refraction, the incident light is reflected in its entirety.

Referring to FIGS. 15(*b*) and 15(*c*), the relationship between the index of refraction and angle of incidence is set so that as the light from the light emitting member 21 is guided into the light path 101 and reaches the slanted face 12*e* of the optical switch 121, it will be reflected in totality. The relationship between the index of refraction and angle of incidence at the slanted face 12*f* of the optical switch 121 is also set so that the light emitted from the light emitting member 21 is totally reflected by the interface between the slanted face 12*f* and air. With the provision of this arrangement, the optical switch 12 in the light path 101 is remains in "ON" condition while the ink container is in the condition in which the light from the light emitting member 21 is totally reflected (out-of-ink condition shown in FIG. 15(*c*)); in other words, the light from the light emitting member 21 is allowed to reach the tab portion of the lever 2 through the light path 101 inclusive of this optical switch 121.

Next, the switching function of the optical switch 121 will be described in more detail.

As described with regard to the first embodiment, as long as the angle of the slanted face 12*c* of the optical switch 121, and the angle of incidence of light relative to the slanted face 12*c*, are properly selected according to the index of refraction of the ink 11, the incident light is barely reflected toward the slanted face 12*d* of the prism 12 by the slanted face 12*c* of the optical switch 121, while the amount of the ink 11 in the ink container 100 is sufficient (FIG. 15(*b*)), but, the incident light reaches the end of the light path 101 on the other side of the optical switch 121 while the amount of the ink 11 in the ink container 100 is insufficient, because while the amount of the ink 11 in the ink container 100 is insufficient, the incident light is totally reflected by the interface between the slanted face 12*c* and air, and the interface between the slanted face 12*d* and air.

In this embodiment, the angles of the slanted faces 12*c* and 12*d* were set to 45° and the angle of incidence is set to also 45°. Further, the ink 11 is a water-based ink, ink which uses water as solvent, or the like, and is 1.32 in index of refraction. The material for the wall of the liquid storage portion 1B is polypropylene, and is 1.50 in index of refraction. In this case, the critical angle of refraction of the light entering the air in the liquid storage portion 1B from the slanted face 12*c* of the prism 12 is 41.8°, and the critical angle of refraction the light entering the liquid 11 in the liquid storage portion 1B from the slanted face 12*c* of the prism 12 is 62.0°. In other words, the angle of incidence (45°) of the incident light is greater than 41.8°. Therefore, while there is a sufficient amount of ink 11 in the liquid storage portion 1B as shown in FIG. 15(*b*), the incident light is not reflected in totality, whereas when there is virtually no ink 11 in the liquid storage portion 1B as shown in FIG. 15(*c*), the incident light is reflected in totality, because the angle (45°) of the incidence of the incident light is smaller than 62.0°.

As described above, as the light having traveled through one of the light paths 101 of the holder 200, which correspond one for one to the ink containers in the holder 200, reaches the optical switch 121 which is turned on or off by the absence or presence of a sufficient amount of ink 11 in the ink container, the light is blocked or allowed to travel past the switch 121.

Figure 16:
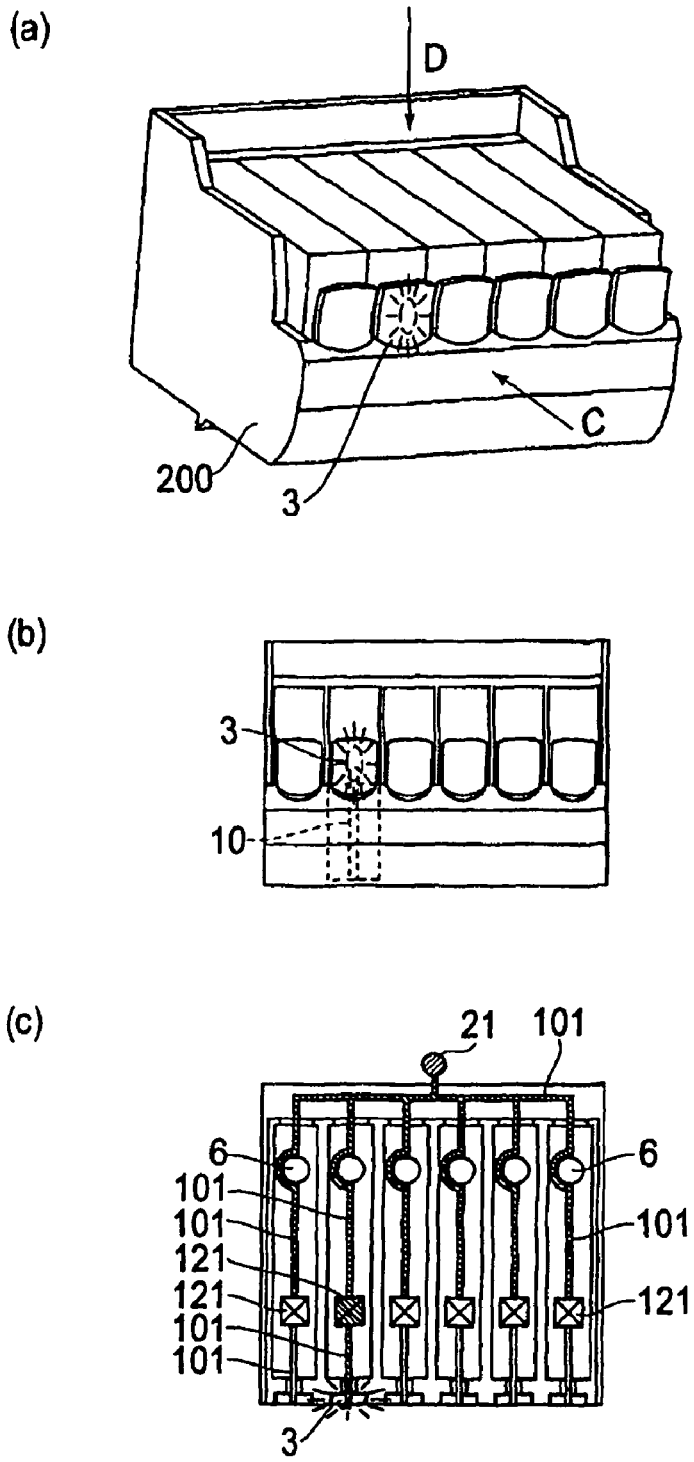
FIGS. 16(*a*)-16(*c*) are drawings for describing the relationship between the light path and the finger placement portion (tab portion) of the ink container, in the second embodiment of the present invention.

FIGS. 16(*a*)-16(*c*) are drawings of the holder 200, and the multiple ink containers held therein, showing how the tab portion of one the multiple ink containers is illuminated when the ink container is in the out-of-ink condition. As shown in FIGS. 16(*a*) and 16(*b*), the tab portion 3 of the ink container which is in the out-of-ink condition, is illuminated.

FIG. 16(*c*) is a drawing showing the light paths 101 and optical switches 121 of the multiple ink containers in the holder when one of the ink containers is out of ink. As shown in the drawing, as one of the ink containers runs out of ink, the condition of the optical switch 121 of this ink container turns into the one shown in FIG. 15(*c*); the light path 101 is completed, allowing thereby the light from the light emitting member 21 to reach the tab portion 3 of the lever 2 to illuminate it. On the other hand, the optical switches of the other (five) ink containers, the detectable condition of which is the presence of a sufficient amount of ink, are in the condition shown in FIG. 15(*b*); the light path 101 is interrupted. Therefore, it does not occur that the light from the light emitting member 21 is guided to the tab portion 3 of the lever 2.

As described above, in this embodiment, the optical switch 121, the actions of which are tied to the presence and absence of a sufficient amount of the ink 11 in each of the ink containers 100, is employed. Thus, the control portion of the main assembly of the printer has only to turn on the light emitting member 21 as the sensor 14 detects the absence of the ink in one of the ink containers. That is, the structural arrangement for determining the tab portion 3 of which ink container 100 is to be illuminated is unnecessary. Further, it is unnecessary to provide the holder 200 with multiple light emitting members 21, that is, one for each ink container 100; only a single light emitting member is needed for multiple ink containers 100 in order to illuminate the tab portions 3 of a specific ink container (ink container having run out of ink) from among the multiple ink containers.

Further, referring to FIGS. 16(*a*) and 16(*b*), as a given ink container runs out of the ink 11, the tab portion 3 of the given ink container itself, that is, the ink container to be replaced, is illuminated. Therefore, not only can a user accurately determine at a glance which ink container 100 is to be replaced, but also, what portion of the ink container to be replaced is to be manipulated to remove the ink container.

Figure 17:
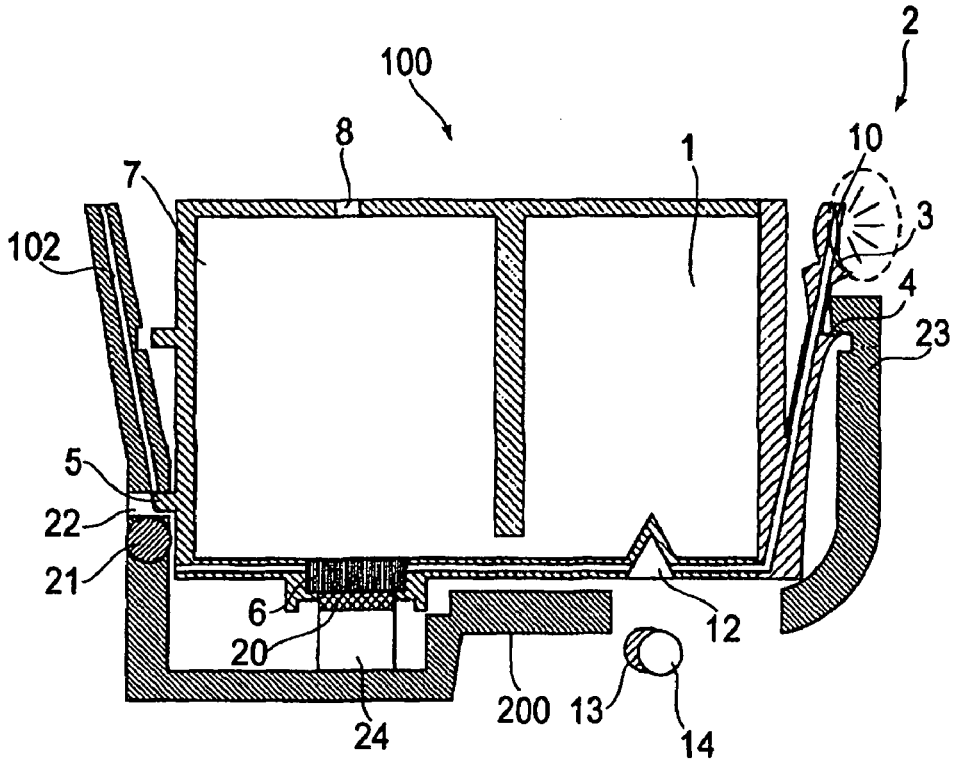
FIG. 17 is a drawing for describing how the ink remainder amount is detected by the optical switch in the second embodiment of the present invention.

FIG. 17 is a drawing of the holder 200, and the ink container 100 therein, the out-of-ink condition of which has been detected. As described above, the tab portion 3 is illuminated, and a user is to remove the ink container having the illuminated tab portion 3 to replace it with an ink container having a sufficient amount of the ink 11.

Figure 18:
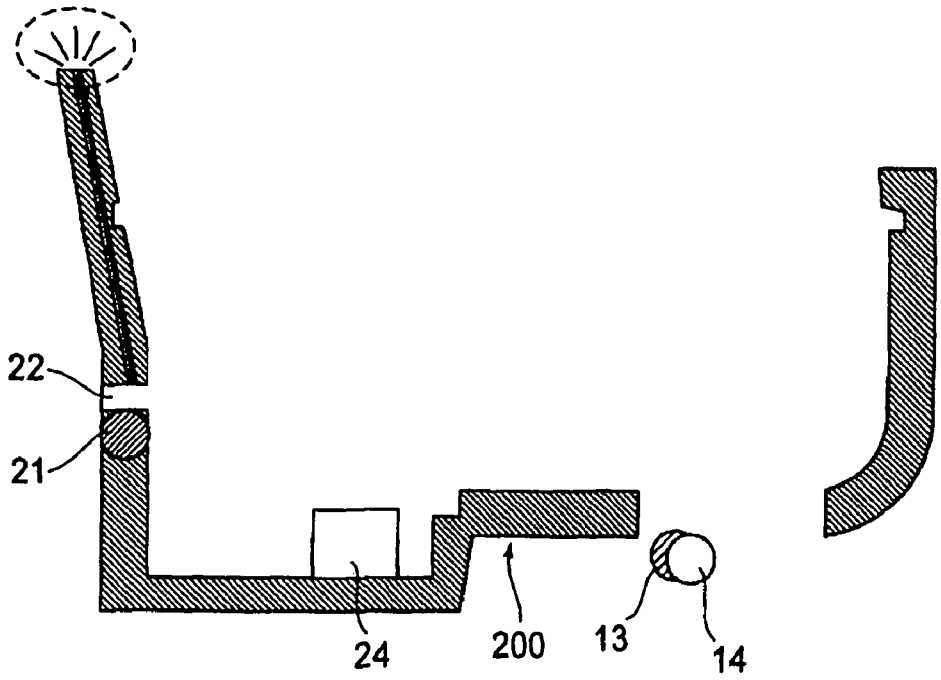
FIG. 18 is a schematic sectional view of the ink container holder in the second embodiment of the present invention, from which an ink container has been removed.
Figure 19:
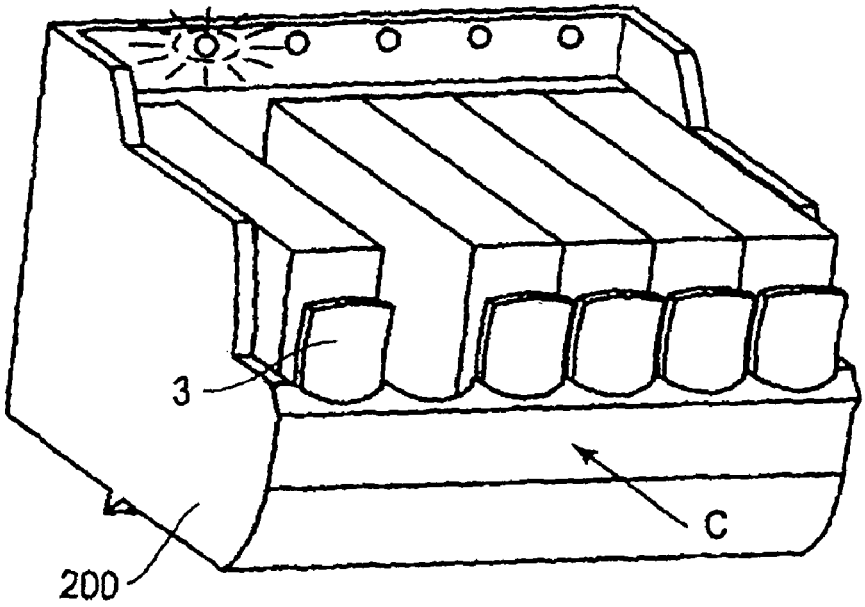
FIGS. 19(*a*) and 19(*b*) are drawings of the ink container holder in the second embodiment of the present invention, from which an ink container has been removed.
Figure 19:
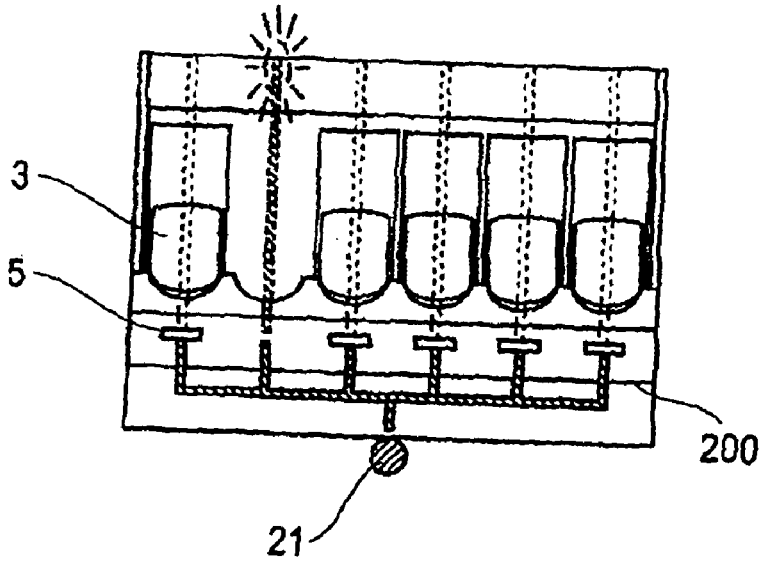

FIG. 18 is a sectional view of a holder different from the holders in the preceding embodiments. FIGS. 19(*a*) and 19(*b*) are perspective and phantom top views of the holder shown in FIG. 18, from which one of the ink containers has been removed. The holder shown in FIG. 18 is provided with multiple light paths 102, one for each ink container slot, in addition to the abovementioned multiple light paths 101. The control portion of the printer controls the light emitting member 21 so that the light emitting member 21 continues to emit light even after the removal of an ink container. Thus, after the removal of a given ink container, the light from the light emitting member 21 travels, through the light path 102 corresponding to the removed ink container, to the top end of the light path 102, illuminating it. Therefore, a user can instantly determine the ink container slot into which a replacement ink container is to be mounted.

To described in more detail, when the ink container 100 is in the holder 200, the light emitted from the light emitting member 21 is blocked by the positioning projection 5 of the ink container 100. However, as soon as the ink container 100 is removed, the light emitted from the light emitting member 21 is allowed to enter the light path 102, illuminating the opposite end of the light path 102 as shown in FIGS. 18 and 19, because the removal of the ink container 100 removes the projection 5 from the position in which it blocks the light from the light emitting member 21 as shown in FIG. 18. In other words, the positioning projection 5 of the ink container 100 functions as an optical switch; the removal of the projection 5 turns on the switch, illuminating thereby the end of the light path 102, on the top side of the holder 200. With the provision of this arrangement, only the top end of the light path 102 belonging to the ink container slot, from which the ink container 100 has been removed, is illuminated, making it possible for a user to instantly recognize where a replacement ink container 100 is to be mounted.

(Miscellanies)

In the first embodiment, a given ink container was indicated when the given ink container is out of ink. However, the condition under which a given ink container is indicated does not need to be the above described one. For example, a structural arrangement may be made so that when one of recording heads is malfunctioning, the aforementioned tab of the locking lever of the ink container corresponding to the malfunctioning recording head is illuminated.

INDUSTRIAL APPLICABILITY

As described above, according to the present invention, it is possible to provide the combination of a liquid storage container, such as an ink container, and an ink jet recording apparatus, which can directly display to a user a predetermined condition(s), the identity, and the location, of the container, while being simple in structure.

While the invention has been described with reference to the structures disclosed herein, it is not confined to the details set forth, and this application is intended to cover such modifications or changes as may come within the purposes of the improvements or the scope of the following claims.

The invention claimed is:

1. An ink container comprising:

a containing portion constructed to contain ink;

a lever member extending away from the containing portion, wherein the lever member includes an operating portion which is operable for detachable mounting of the ink container to a holder;

wherein the lever member is provided with an optical path starting at a base end of the lever member and ending at the operating portion to direct light received at the base end to the operating portion where the light emerges.

2. An apparatus according to claim 1, wherein the optical path is provided by a core of a material having a relatively high refractive index and a clad of a material having a relatively low refractive index, wherein the core is provided by the lever member, and air around the core functions as the clad.

3. An ink container according to claim 1, wherein the optical path extends from the base end through a bottom portion of the ink container, and wherein the bottom portion of the ink container is provided with a prism for detecting a remaining amount of ink in the containing portion, and the prism is provided across the optical path of the bottom portion.

4. An ink jet recording apparatus including a head and a holder, and further comprising an ink container which includes:

a containing portion constructed to contain ink;

a lever member extending away from the containing portion, wherein the lever member includes an operating portion which is operable for detachable mounting of the ink container to a holder;

wherein the lever member is provided with an optical path starting at a base end of the lever member and ending at the operating portion to direct light received at the base end to the operating portion where the light emerges, wherein the ink jet recording apparatus further comprises a first light emitting portion, wherein light emitted by the first light emitting portion is received at the base end and emerges at the operating portion through the lever member.

5. An apparatus according to claim 4, wherein the optical path is provided by a core of a material having a relatively high refractive index and a clad of a material having a relatively low refractive index, wherein the core is provided by the lever member, and air around the core functions as the clad, and wherein the lever member is provided with a light receiving surface at the base end and the first light emitting portion is disposed opposed to the light receiving surface.

6. An ink jet recording apparatus including a head and a holder, and further comprising an ink container which includes:

a containing portion constructed to contain ink;

a lever member extending away from the containing portion, wherein the lever member includes an operating portion which is operable for detachable mounting of the ink container to a holder;

wherein the ink container is provided with an optical path through a bottom portion thereof and through the lever member, and is provided with a prism for detecting a remaining amount of ink in the containing portion across the optical path;

wherein the ink jet recording apparatus further comprises a first light emitting portion for emitting light to the prism and a light receiving portion for receiving light reflected by the prism, and wherein the holder is provided with a second light emitting portion, wherein light emitted by the second light emitting portion is received at the bottom portion and emerges from the operating portion through the prism.

7. An apparatus according to claim 6, wherein the holder is provided with a second optical path, and wherein in a state that the ink container is mounted to the holder, the second light emitter and the second optical path is blocked by the ink container, and in a state that the ink container is dismounted, light from said second light emitter reaches a receipt end of the second optical path, and the light reaches an emergent end of said optical path where the light emerges.

* * * * *